US008479399B2

(12) United States Patent
Putsch

(10) Patent No.: US 8,479,399 B2
(45) Date of Patent: Jul. 9, 2013

(54) PLIERS AS MIDDLE CUTTER OR SIDE CUTTER

(75) Inventor: Ralf Putsch, Wuppertal (DE)

(73) Assignee: KNIPEX-Werk C. Gustav Putsch KG, Wuppertal (DE)

( * ) Notice: Subject to any disclaimer, the term of this patent is extended or adjusted under 35 U.S.C. 154(b) by 57 days.

(21) Appl. No.: 12/735,488

(22) PCT Filed: Jan. 7, 2009

(86) PCT No.: PCT/EP2009/050135

§ 371 (c)(1),
(2), (4) Date: Aug. 31, 2010

(87) PCT Pub. No.: WO2009/087174

PCT Pub. Date: Jul. 16, 2009

(65) Prior Publication Data

US 2011/0005086 A1 Jan. 13, 2011

(30) Foreign Application Priority Data

Jan. 9, 2008 (DE) ..... 10 2008 003 723

(51) Int. Cl.
*B26B 17/00* (2006.01)
*B25B 7/06* (2006.01)

(52) U.S. Cl.
USPC ..... 30/191; 30/267

(58) Field of Classification Search
USPC ..... 30/175, 191, 173, 192, 193, 252, 30/190, 349, 267; 81/348
See application file for complete search history.

(56) References Cited

U.S. PATENT DOCUMENTS

| | | | | |
|---|---|---|---|---|
| 509,125 | A | 11/1893 | Humann | 30/252 |
| 1,034,345 | A | 7/1912 | Compton | |
| 1,762,562 | A | 6/1930 | Roberts | 81/10 |
| 1,914,025 | A | 6/1933 | Keith | |
| 2,806,394 | A | 9/1957 | Briegel | 72/409.19 |
| 5,014,432 | A | 5/1991 | Putsch et al. | |
| 6,918,324 | B2 | 7/2005 | Hsien | 81/427.5 |
| 7,249,752 | B1 | 7/2007 | Foley | |
| 2006/0168820 | A1 | 8/2006 | Chen | 30/175 |
| 2009/0126539 | A1 | 5/2009 | Foley | 81/418 |

FOREIGN PATENT DOCUMENTS

| | | |
|---|---|---|
| DE | 94 06 868 | 8/1995 |
| DE | 298 08 557 | 10/1998 |
| EP | 0 331 927 | 9/1989 |
| FR | 2 744 660 | 8/1997 |
| FR | 2 746 049 | 9/1997 |

OTHER PUBLICATIONS

International Search Report.

*Primary Examiner* — Ghassem Alie
(74) *Attorney, Agent, or Firm* — Collard & Roe, P.C.

(57) ABSTRACT

Pliers (1) as middle cutter or side cutter having plier jaws (4, 5) configured on plier legs, with a work range, wherein the plier legs with grip areas (2, 3) and configured to cross over one another around bearing bolts (6, 7) connected by a cover plate (8) are pivotably supported. The plier jaws on the working region side of the cover plate (8) and the crossing region (K) of the plier legs are configured on the other side of the cover plate (8). In order to improve the handling of these pliers, that relative to a side elevation, on the grip side with respect to the cover plate (8) in the plier legs, a tangential bend (A) is configured in which resultantly created different pivot planes (E1-E1) or (E2-E2) of the plier legs cross one another. The grip areas (2, 3) run in one pivot plane (E2-E2) and in another pivot plane (E1-E1) areas of the plier legs extended on the work range side of the tangential bend (A) run.

13 Claims, 6 Drawing Sheets

PLIERS AS MIDDLE CUTTER OR SIDE CUTTER

CROSS REFERENCE TO RELATED APPLICATIONS

This application is the National Stage of PCT/EP2009/050135 filed on Jan. 7, 2009, which claims priority under 35 U.S.C. §119 of German Application No. 10 2008 003 723.0 filed on Jan. 9, 2008, the disclosure of which is incorporated by reference. The international application under PCT article 21(2) was not published in English.

BACKGROUND OF THE INVENTION

1. Field of the Invention

The invention relates to a pliers, such as a center cutter or a side cutter, having pliers jaws that are formed on pliers limbs and have a working region, the pliers limbs, which have gripping regions and are formed to cross over one another, being pivotably mounted by bearing bolts that connect a cover plate, and the pliers jaws being formed on the working region side of the cover plate and the cross-over region of the pliers limbs being formed on the other side of the cover plate. Here there are in question in particular high force ratio jaws, to which there belong also jaws such as pressing jaws and crimping jaws.

2. The Prior Art

A pliers of this kind is known for example from EP 331 927 B1. The disclosure content of this patent specification is hereby included in full in the disclosure of the present application, in respect of the basic construction of the pliers, in particular also in respect of the tooth-space engagement and of the run of the pliers limbs, as well as the principle of holding together by means of a cover plate, also for the purpose of incorporating features of the above-mentioned specification in claims of the present application.

Reference is also made to U.S. Pat. No. 2,806,394 A as prior art.

SUMMARY OF THE INVENTION

In regard to the known pliers, it is an object of the invention to improve the ease with which it may be handled.

This object is met according to a first aspect of the invention by the subject matter of claim 1, it being provided that a tangential bend is formed in the pliers limbs on the gripping side relative to the cover plate, different pivot planes of the pliers limbs created thereby intersecting one another in the bend, the gripping regions running in one pivot plane and regions of the pliers limbs extending on the working region side of the tangential bend running in another pivot plane.

Because of the tangential bend, ease of handling is advantageously more favourable and improved, for example in the case that the pliers has to be placed such that the user's fingers engaging around the gripping region would already collide with a base or an upstanding feature. The tangential bend enables an advantageous separation of the working plane and the plane or the raised region in which the user's fingers engage around the handles. By virtue of the tangential bend being formed on the gripping side of the cover plate, the cutting region and also the cover-plate region of the known pliers remain unchanged. The favourable cutting properties continue to be obtained, for example in the case of a center or side cutter. In particular, a advantageous clearance for the cutter is also provided above and below.

A further solution to the problem is also provided by the features of claim 2, it being provided that the pliers jaws are held together by only one cover plate, located on one side. In this way, placement of the pliers jaws directly against the working surface is enabled, when the single cover plate is located on the top. In principle, a cover plate may also be disposed underneath, and thus enable, in the upper side region, advantageous bringing against a workpiece or introduction into a working space.

Further features of the invention are explained below, which are in principle significant both combined with one or more of the features of the groups of features explained above, as well as however also independently.

Thus it is preferred that the cross-over region of the pliers limbs runs on the gripping side of the tangential bend. The gripping regions thus run through, in side view, together with the cross-over region of the pliers limbs, practically in a straight line. The tangential bend is then formed further toward the cover plate, preferably by virtue of bending deformation, in the pliers limb that runs through and is also preferably integral, so that the adjoining region of the pliers limbs, which is also referred as a whole as a head region of the pliers, extends in another pivot plane compared with the combined region of the gripping regions and the cross-over region.

As an alternative to this, the cross-over region of the pliers limbs may also run on the working region side of the tangential bend. The cross-over region then extends, preferably together with the portion of the pliers limbs forming the head region, in a common pivot plane, which is different from the pivot plane of the gripping regions.

More preferably, also only two different pivot planes are formed on the pliers.

It is further preferred that the cover plate is located on the inner side, when a tangential bend is provided; this means on the inner side of the angle in side view, thus in the space which encloses the smaller angle.

It is also further preferred that the rear sides of the pliers jaws, opposite from the cover plate, form a common contact face, which can be directly engaged against a workpiece or a base, because it is free of upstanding features. The rear sides of the pliers jaws, which in principle, as already stated above, may be the "upper side", merge in this way into one another, preferably in alignment, thus form in any case a common contact plane in a substantial part of the rear side surface. A part of or the entire rear side of the cross-over region of a pliers limb in the cross-over region may also be incorporated into this contact plane. Because of the crossing-over arrangement, this rear side of the pliers limb in the region mentioned also results in additional stabilising of the contact.

The bearing mounting for the pliers jaws is further formed by means of a tooth-space engagement securing the pliers jaws to one another. This tooth-space engagement is preferably formed by a roller member. This roller member may be formed on one of the pliers jaws or also as a separate part, then preferably as a basically cylindrical pin.

When the tooth-space engagement is formed by the separate pin, it is further preferred that this bearing pin is of stepped form. A stepped embodiment of this kind enables the bearing pin to be held in a positive manner even when only one cover-plate is provided. While it is restrained against movement in one direction by the cover-plate, it is restrained against movement in the other direction—in the direction of its longitudinal axis—by the stepped formation. The stepped formation must not be formed as a continuous ongoing decrease in diameter. It may also be formed only by a groove, in which a protrusion from the pliers jaws engages.

In general form, it is provided that positive holding of the bearing bolt is achieved on the one hand by interaction with the cover plate and on the other hand by interaction with the pliers jaws.

In regard to the mounting of the preferably one cover plate by means of bearing pins, it is further preferably provided that these are held in the pliers jaws in rivet-like manner. For this, an end face of one of the bearing pins may form a part region of a rear side face of a pliers jaw or may be arranged offset relative to this; the latter preferably in the sense that a set back portion relative to the rear side face results. The other end region of the bearing pin may be formed in the manner of a rivet head.

BRIEF DESCRIPTION OF THE DRAWINGS

The invention is explained further below with reference to the accompanying drawing, which however relates only to an embodiment. In the drawings.

DETAILED DESCRIPTION OF THE PREFERRED EMBODIMENTS

Figure 1:
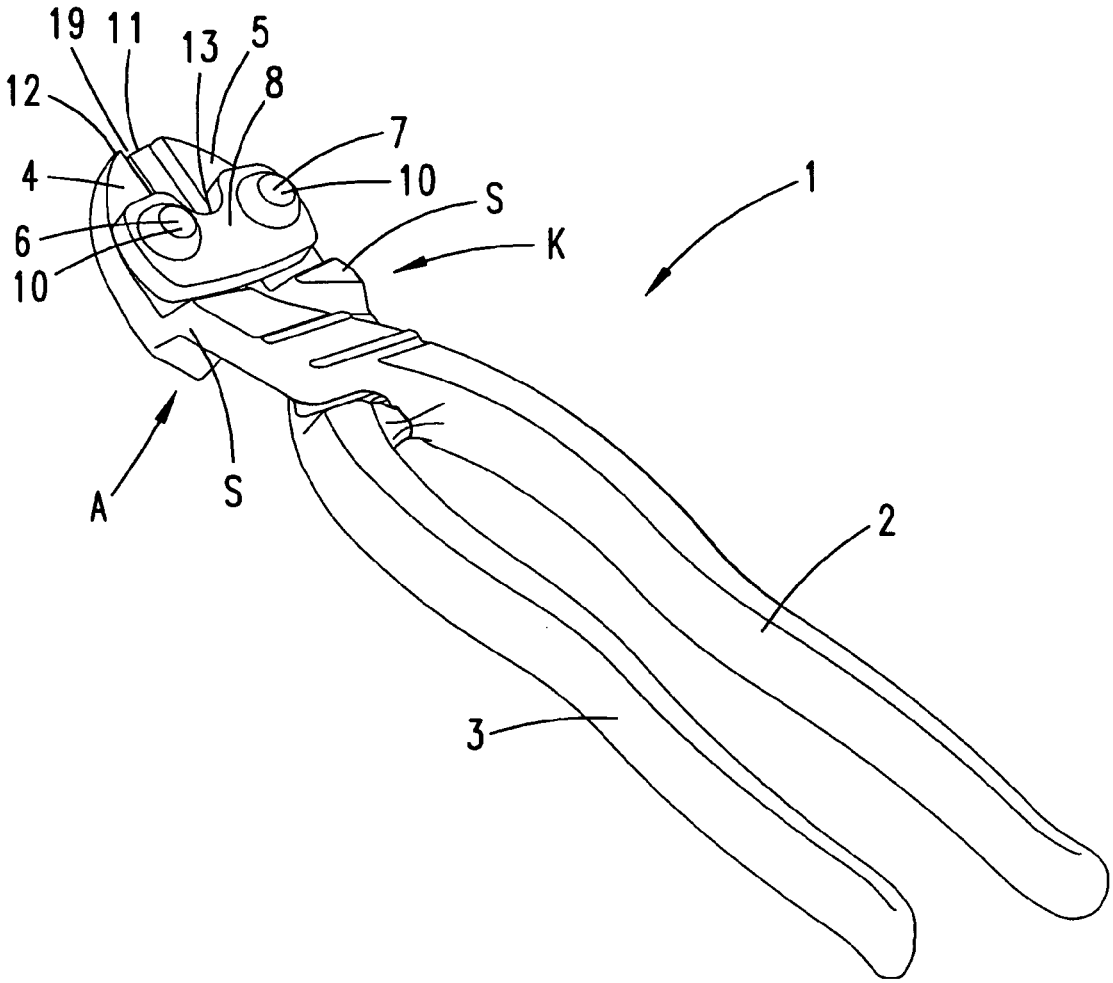
FIG. 1 is a perspective view of the pliers.
Figure 2:
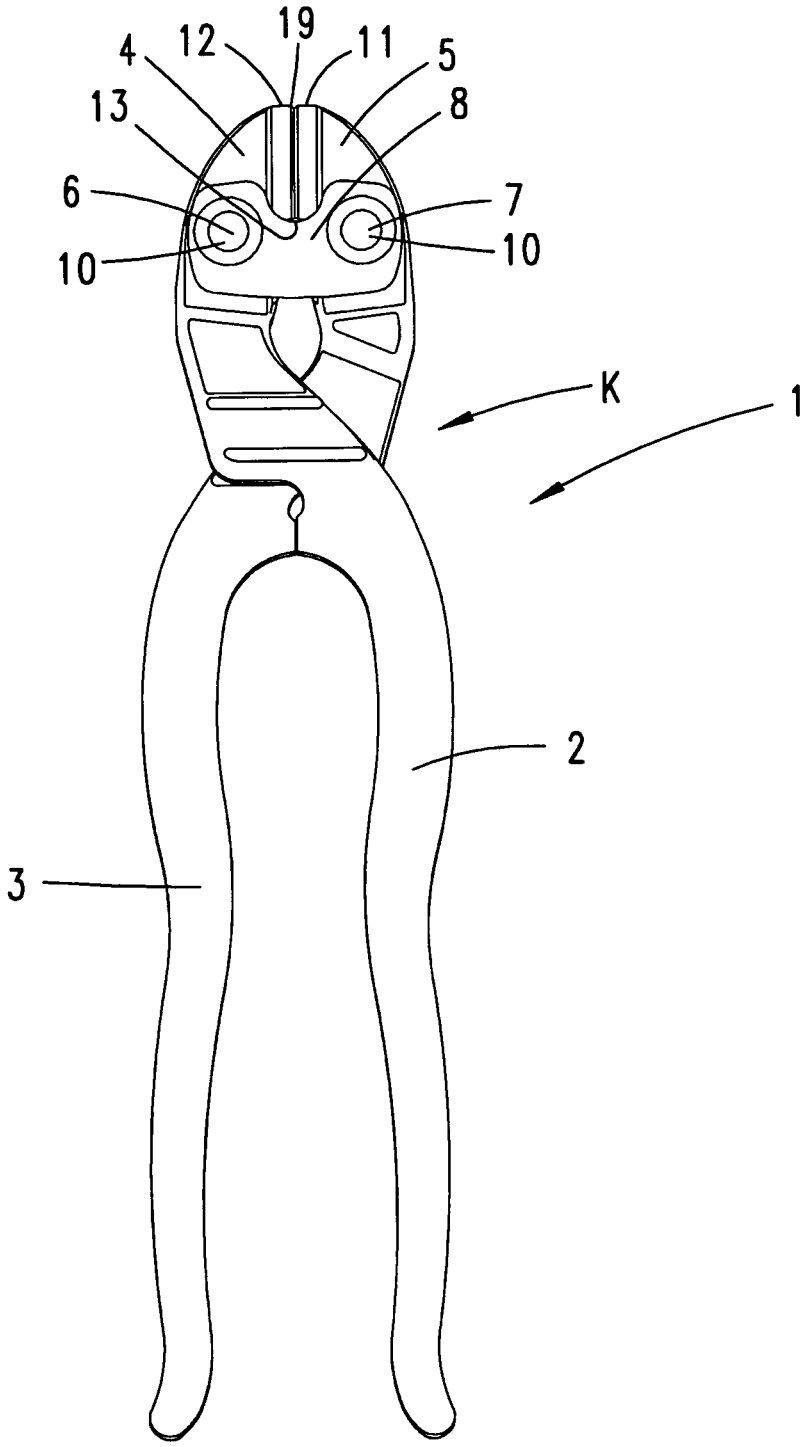
FIG. 2 is a plan view of the pliers.

Shown and described is a pliers 1 formed as a center cutter having two pliers limbs, which form gripping regions 2, 3, these gripping regions each continuing initially into a cross-over region K of the pliers limbs and then integrally into a pliers jaw 4, 5. The pliers limbs are forgings. Each gripping region 2, 3 and pliers jaw 4, 5 is pivotably mounted on a bearing bolt 6, 7. The bearing bolts 6, 7 extend transversely to a pivot plane of the pliers jaws in the front cutting region of the pliers jaws.

The gripping regions 2, 3 cross over each other without any pivot pin before they pass into the region of the cover plate 8 which connects the pivot bolts 7, 6, accordingly after they change side relative to one another. The bearing bolts 6, 7 pass through openings in the cover plate 8 that match the cross-section of the bolts. The cover plate 8, which is disposed on one side only, according to FIG. 1 on the upper side of the pliers shown there, is of plate-like form. The cover plate 8, which is of substantially elongate rectangular shape, has its longitudinal axis extending transversely to the longitudinal extent of the gripping regions 2, 3.

In order to fix the bearing bolts 6, 7, these have, at one end, (cf. for example FIG. 4) heads 9 and at the other end, are in the form of a rivet 10. The heads have a frustoconical shape. The rivet portions are rounded transversely.

In the region of the cutters 11, 12 that form the working region of the pliers jaws 4, 5 and are directed toward one another, the cover plate 8 has an inwardly rounded recess, this for example advantageously with respect to a centring action for an item to be cut, such as for example a wire.

The pliers jaws 4, 5 are formed to be visible on the working region side of the cover plate 8, while the cross-over region K of the pliers limbs is formed on the other side of the cover plate 8, the gripping region side of the cover plate 8.

Figure 3:
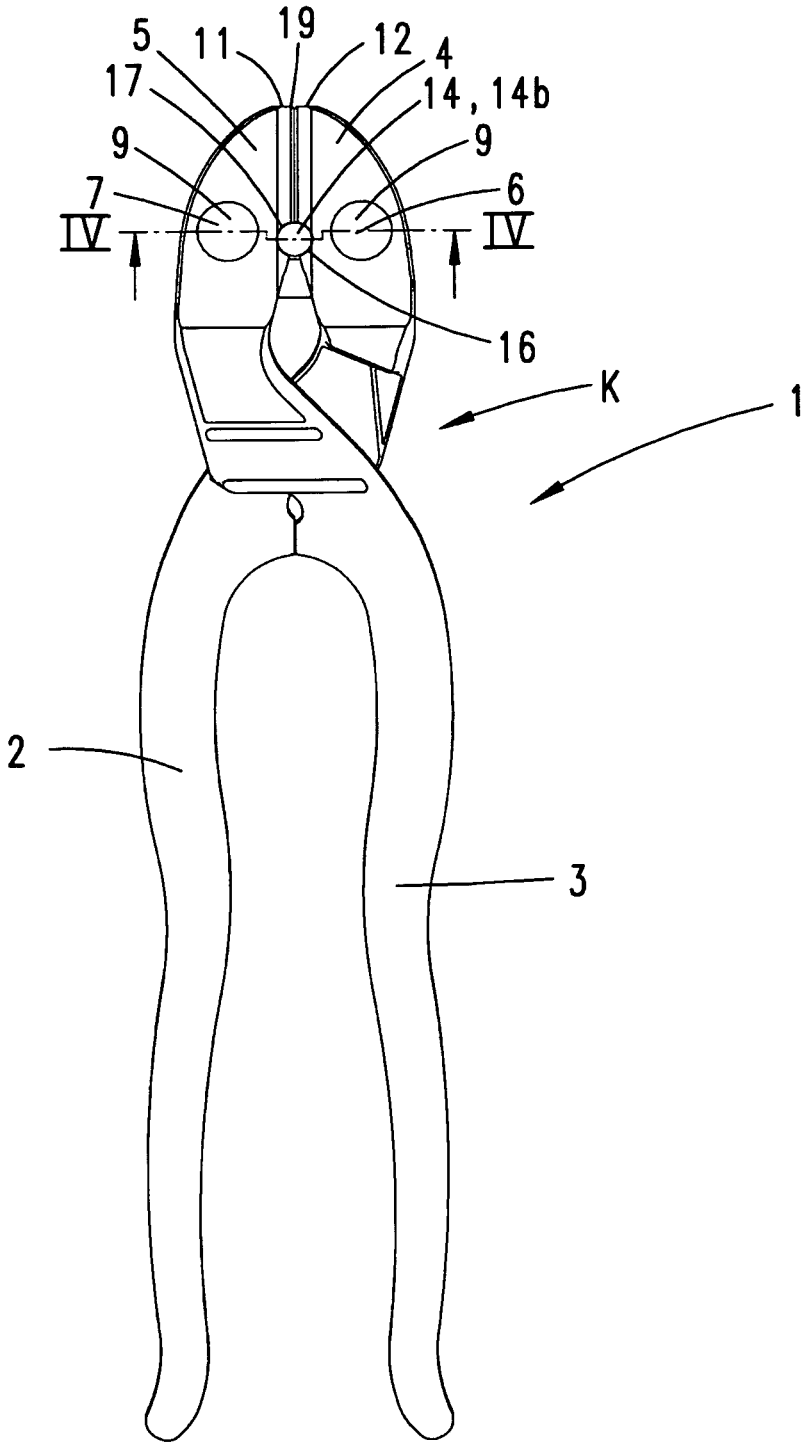
FIG. 3 is a view corresponding to FIG. 3, from the rear.
Figure 4:
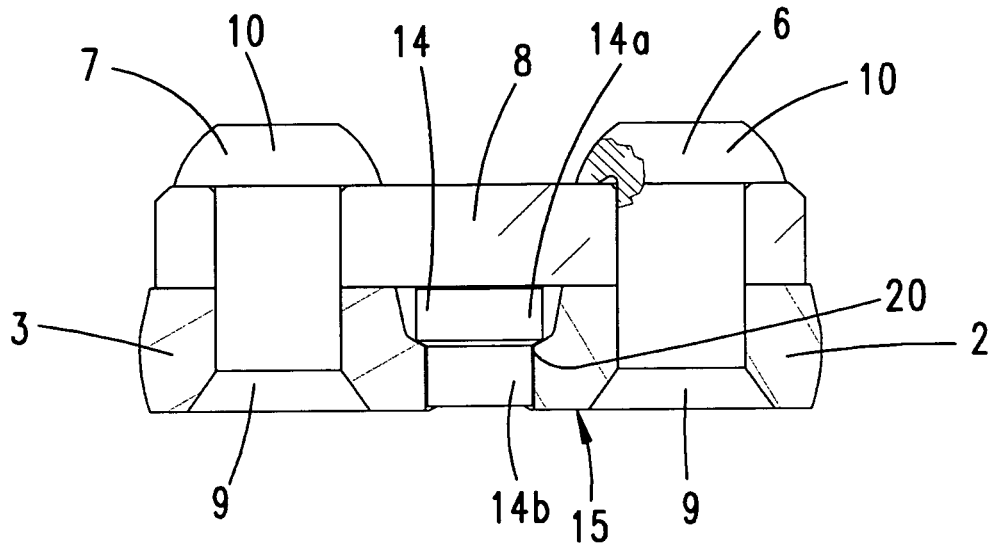
FIG. 4 shows a cross-section through the item of FIG. 3, sectioned along the line IV-IV.
Figure 7:
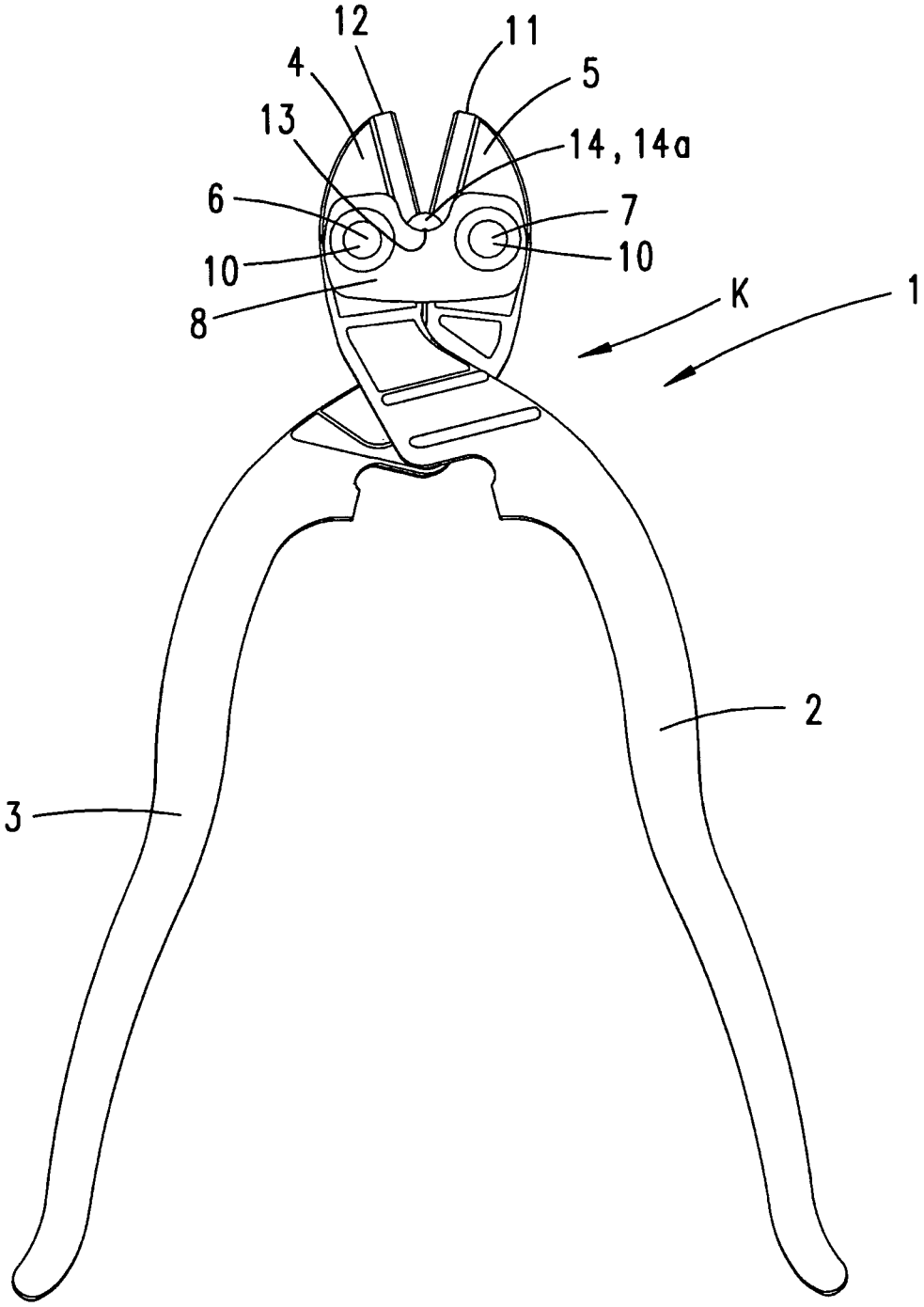
FIG. 7 is an illustration of the pliers in the opened state.

A roller member 14, cf. for example FIGS. 3, 4 and 7, is housed between the bearing bolts 6, 7, at the same spacing from each bolt. The roller member 14 forms a kind of tooth space engagement between the cutting jaws and 12. The roller member 14 is basically of cylindrical configuration. Its edges are bevelled.

Figure 5:
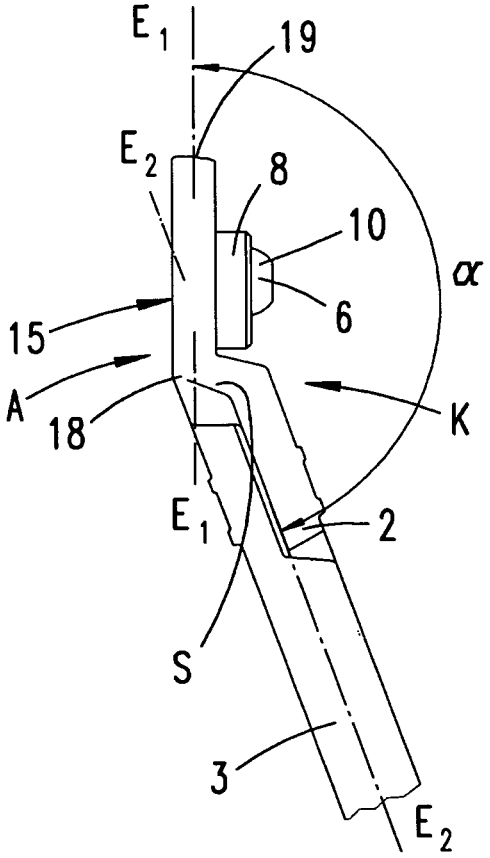
FIG. 5 shows a side view of the pliers, relating the head region, with part of the jaw limb adjoining the cover plate on the grip region side, with a first arrangement of the tangential bend.
Figure 6:
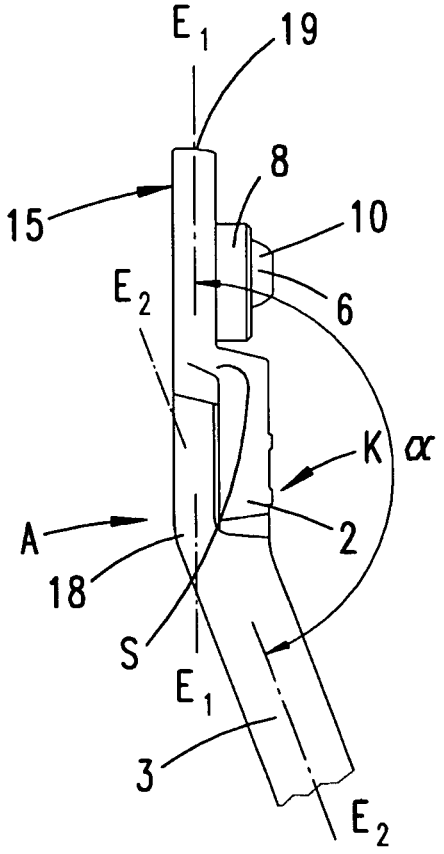
FIG. 6 is an illustration corresponding to FIG. 5, with a second arrangement of the tangential bend.
Figure 8:
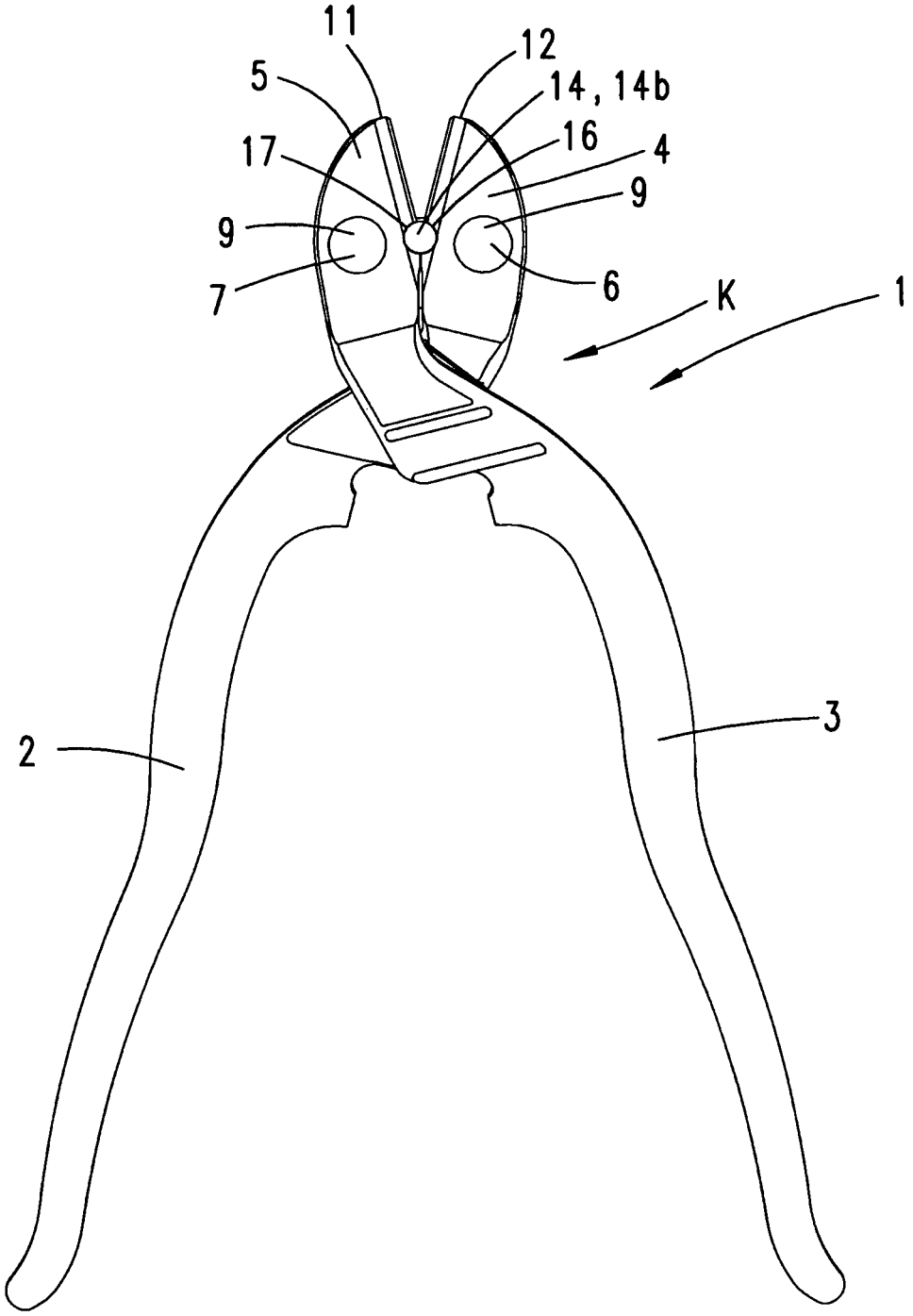
FIG. 8 is an illustration corresponding to FIG. 6, showing the rear side.

The axial length of the roller member 14 corresponds more or less to the clear space from the underside of the cover plate 8 to the contact face 15 formed by the rear side of the pliers jaws 4, 5, see for example FIGS. 4 to 6. Preferably the length is a little less. The roller member 14, which is cylindrical and extends transversely to the cutters 11, 12, is thus seated, respectively partially, in a corresponding through cavity formed by two cavity portions 16, 17 of the cutters 11, 12, see for example FIG. 8. Since the cutters 11, 12 are wedge-shaped and the roller member 14 is of cylindrical shape, the cavity portions 16, 17 have, in the exemplary embodiment, a lens-shaped wall profile.

As will be apparent from a comparison between FIGS. 1 and 7, the roller member 14 appears to move forwards when the pliers are opened and passes partially underneath the cover plate 8. In reality, the cover plate 8 actually moves somewhat to the rear, cf. also FIGS. 3 and 8 which relate to the view from beneath.

The roller member 14 may be formed not only as a separate part, as in the exemplary embodiment, but may also be produced to be fixedly connected to one of the pliers jaws or even integral with this. Only the other pliers jaw then has the recess 16.

The adjoining offset cross-over region K of the gripping regions 2, 3, on the gripping side behind the cover plate 8, is clearly widened as compared with the gripping zone and the jaw zone (see for example the plan view according to FIG. 1). As a rule, the faces of the pliers limbs in this cross-over region K do not however engage on one another, but move with a spacing with respect to each other.

Referring to a side view, as is shown for example in FIGS. 5 and 6, the tangential bend A is formed in each case on the gripping side of the cover plate 8. The portions of the pliers limbs adjoining the tangential bend A to each side thus run in different pivot planes E1-E1 and E2-E2 respectively. The pivot planes E1-E1 and E2-E2 intersect one another in the region of the tangential bend A.

In the exemplary embodiment of FIG. 5 (FIGS. 1 to 3 and 7, 8 also relate in each case to this embodiment), the pliers jaws which appear in the side view in the form of plates that are as a whole in one piece and the region of the pliers limbs that extends underneath the cover plate run in the pivot plane E1-E1, while the cross-over region K together with the gripping regions 2, 3 extends in the pivot plane E2-E2. The planes E1-E1 and E2-E2 together enclose an angle alpha, which is less than 180°.

The respective tangential bend A is, in further detail, formed by a bendingly formed portion 18. The bendingly formed portion 18 is formed in the region of the pliers limb that is considerably reduced in thickness compared with the gripping regions 2, 3; in the case of the embodiment according to FIG. 5, also—seen form the cover plate 8—before the step S formed in one pliers limb, which on the one hand is necessary for the cross-over of the pliers limbs, on the other hand, in the case of the other pliers limb, see for example FIG. 1, is provided as a stabilising built-up mass of material. In this case, the notch-like cut between the cover plate and the step S or the related built-up material of the other pliers limb is also used for the bend.

The reduction in thickness is 10 to 70%, preferably for example 40 to 50%, of the thickness in the gripping region 2, 3. In this regard, with reference to the larger percent range, all intermediate values are also included in the disclosure.

The pliers 1 has only one cover plate 8. With reference to the angle alpha, cf. FIGS. 5, 6, which in each case characterises the tangential bend A, this cover plate 8 is disposed in the interior of the angle.

On the side facing away from the cover plate 8, the rear side of the pliers jaws 4, 5, the pliers jaws 4, 5 form a common planar contact face 15. In the exemplary embodiment, this contact face 15 extends, as shown, over practically the entire transverse region of the secured-together pliers jaws 4, 5 and, in the elongate direction of the pliers, from a tip 19 as far as the tangential bend A. This contact plane is also free of upstanding features. It is therefore not for example interrupted by projecting pin portions or rivet heads. It is therefore suitable for direct engagement against a workpiece or for contact against a base.

In the case of the exemplary embodiment of FIG. 6, the cross-over region K, or the rear side of this, is also incorporated into the contact face 15. By contrast, in the case of the exemplary embodiment of FIG. 5, only the rear side region of the pliers limbs that extends from the tip 19 as far as the tangential bend A, or the pliers jaws 4, 5 formed by this, is incorporated into the contact face 15.

In further detail, it is important that the angle alpha is between 110° and 175°; preferably between 150° and 165°, all degree values as well as fractions of degrees of the first range noted being here included in the disclosure.

The heads 9 mentioned of the bearing bolts 6, 7 passing through the cover plate 8 form a planar, lower, outwardly lying boundary surface, which likewise lies in the contact face 15 mentioned or is optionally set back somewhat relative to this in the direction of the cover plate 8.

In the same manner, the roller member 14 forms a lower end face, which likewise lies in the contact face 15 or, as in the case of the exemplary embodiment, is set back slightly from this in the direction of the cover plate 8.

The roller member 8 itself is formed in a stepped manner. It has an upper larger-diameter region 14*a* and a lower smaller-diameter region 14*b*, see FIG. 4.

Since the transition between the regions 14*a* and 14*b* is located at a corresponding shoulder 20 of the pliers jaws 4, 5 and on the other hand, as already mentioned, the roller member 14 is covered, in the upward direction, by the cover plate 8, the roller member 14 is thus secured in the pliers head in a positive manner.

All features disclosed are (in themselves) pertinent to the invention. The disclosure contents of the associated/attached priority documents (copy of the prior application) are hereby also included in full in the disclosure of the application, also for the purpose of incorporating features of these documents in claims of the present application.

The invention claimed is:

1. A pair of pliers (1), having pliers jaws (4, 5) that are formed on pliers limbs, the pliers jaws are forming a working region, wherein further the pliers limbs have gripping regions (2, 3), are crossing over one another and being pivotably mounted by bearing bolts (6, 7), the bearing bolts (6, 7) being connected by a cover plate (8), and wherein further the pliers jaws being formed on the working region side of the cover plate (8) and the cross-over region (K) of the pliers limbs being formed on the gripping region side of the cover plate (8), wherein a tangential bend (A), as seen in a side view, is formed in the pliers limbs on the gripping side relative to the cover plate (8), different pivot planes (E1-E1 and E2-E2) of the pliers limbs created thereby intersecting one another in the bend, the gripping regions (2, 3) running in one pivot plane (E2-E2) and regions of the pliers limbs extending on the working region side of the tangential bend (A) running in another pivot plane (E1-E1); and wherein said cross-over region (K) of the pliers limbs runs on the gripping side of the tangential bend (A), wherein further the gripping regions (2, 3) cross over each other without any pivot pin, before they pass into the region of the cover plate (8); and wherein there is only one cover plate (8); and wherein the cover plate (8) is located on an inner side, with respect to the tangential bend.

2. A pair of pliers according to claim 1, wherein the pliers jaws (4, 5) are held together by only the cover plate (8), located on one side, and the bearing bolts.

3. A pair of pliers according to claim 1, wherein the tangential bend is formed by a bendingly formed portion (18).

4. A pair of pliers according to claim 1, wherein a roller member (14) is provided, that fixes the pliers jaws (4, 5) to one another.

5. A pair of pliers according to claim 4, wherein the roller member (14) is covered, at least in part, by the cover plate (8).

6. A pair of pliers according to claim 1, wherein a roller member (14) is of a stepped form.

7. A pair of pliers according to claim 1, wherein a rear side of the pliers jaws (4, 5), opposite from the cover plate (8), form a common planar contact face (15); and wherein the common planar contact face (15) is free of upstanding features.

8. A pair of pliers (1), having pliers jaws (4, 5) that are formed on pliers limbs, the pliers jaws are forming a working region, wherein further the pliers limbs have gripping regions (2, 3), are crossing over one another and being pivotably mounted by bearing bolts (6, 7), the bearing bolts (6, 7) being connected by a cover plate (8), and wherein further the pliers jaws being formed on the working region side of the cover plate (8) and the cross-over region (K) of the pliers limbs being formed on the gripping region side of the cover plate (8), wherein a tangential bend (A), as seen in a side view, is formed in the pliers limbs on the gripping side relative to the cover plate (8), different pivot planes (E1-E1 and E2-E2) of the pliers limbs created thereby intersecting one another in the bend, the gripping regions (2, 3) running in one pivot plane (E2-E2) and regions of the pliers limbs extending on the working region side of the tangential bend (A) running in another pivot plane (E1-E1); and wherein said cross-over region (K) of the pliers limbs runs on the gripping side of the tangential bend (A), wherein further the gripping regions (2, 3) cross over each other without any pivot pin, before they pass into the region of the cover plate (8); and wherein a rear side of the pliers jaws (4, 5), opposite from the cover plate (8), form a common planar contact face (15); and wherein the common planar contact face (15) is free of upstanding features.

9. A pair of pliers according to claim 8, wherein the contact face is formed, in part, by a rear side of the cross-over region of the pliers limb.

10. A pair of pliers according to claim 8, wherein the cover plate (8) is located on an inner side, with respect to the tangential bend; and wherein there is only one cover plate (8).

11. A pair of pliers (1), having pliers jaws (4, 5) that are formed on pliers limbs, the pliers laws are forming a working region, wherein further the pliers limbs have gripping regions (2, 3), are crossing over one another and being pivotably mounted by bearing bolts (6, 7), the bearing bolts (6, 7) being connected by a cover plate (8), and wherein further the pliers jaws being formed on the working region side of the cover plate (8) and the cross-over region (K) of the pliers limbs being formed on the gripping region side of the cover plate (8), wherein a tangential bend (A), as seen in a side view, is formed in the pliers limbs on the gripping side relative to the cover plate (8), different pivot planes (E1-E1 and E2-E2) of the pliers limbs created thereby intersecting one another in the bend, the gripping regions (2, 3) running in one pivot plane (E2-E2) and regions of the pliers limbs extending on the working region side of the tangential bend (A) running in another pivot plane (E1-E1); and wherein said cross-over region (K) of the pliers limbs runs on the gripping side of the tangential bend (A), wherein further the gripping regions (2, 3) cross over each other without any pivot pin, before they pass into the region of the cover plate (8); and wherein the cover plate (8) is held in the pliers jaws (4, 5) by means of the bearing bolts (6, 7) and wherein one end face of the bearing bolt (6, 7) forms a part region of a rear side face of the pliers jaw (4, 5).

12. A pair of pliers according to claim 11, wherein the cover plate (8) is located on an inner side, with respect to the tangential bend; and wherein there is only one cover plate (8).

13. A pair of pliers according to claim 12, wherein a rear side of the pliers jaws (4, 5), opposite from the cover plate (8), form a common planar contact face (15); and wherein the common planar contact face (15) is free of upstanding features.

* * * * *

UNITED STATES PATENT AND TRADEMARK OFFICE

CERTIFICATE OF CORRECTION

PATENT NO. : 8,479,399 B2
APPLICATION NO. : 12/735488
DATED : July 9, 2013
INVENTOR(S) : Ralf Putsch It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 109 days.

Signed and Sealed this
Eighth Day of September, 2015

Michelle K. Lee

Michelle K. Lee
*Director of the United States Patent and Trademark Office*